United States Patent [19]

Brown

[11] Patent Number: 4,834,016

[45] Date of Patent: May 30, 1989

[54] LIFERAFT LAUNCH SYSTEM

[75] Inventor: Robert W. Brown, New Orleans, La.

[73] Assignee: Alexander Manufacturing & Service Co., Inc., New Orleans, La.

[21] Appl. No.: 129,591

[22] Filed: Dec. 7, 1987

[51] Int. Cl.[4] ..... B63B 23/00; B63B 23/06

[52] U.S. Cl. ..... 114/365; 114/366; 114/373

[58] Field of Search ..... 441/42; 114/365, 366, 114/368–373, 375; 212/190

[56] References Cited

U.S. PATENT DOCUMENTS

| | | | |
|---|---|---|---|
| 1,111,836 | 9/1914 | Johnson et al. | 114/373 X |
| 2,546,396 | 3/1951 | Jenkins | 441/42 X |
| 3,593,355 | 7/1971 | Husband | 114/366 |
| 3,678,876 | 7/1972 | Alter | 114/204 X |
| 4,129,910 | 12/1978 | Edwards et al. | 114/365 |
| 4,145,782 | 3/1979 | De Sepio et al. | 114/365 |

*Primary Examiner*—Sherman D. Basinger
*Attorney, Agent, or Firm*—John S. Egbert

[57] ABSTRACT

A liferaft deployment apparatus comprising a frame, a platform, and a liferaft container receptacle. The platform is positioned within the frame and is movable between a liferaft retention position and a liferaft deployment position. The liferaft receptacle receives containers of liferafts. The frame includes a first guide member and a second guide member which extend for the length of travel of the platform. The first guide member and the second guide member are parallel to each other. The frame further includes a stop at the ends of the travel of the platform. The platform includes a first angle member, a second angle member, and a plate extending between the angle members. The platform is mounted on a plurality of rollers. Lock members are included within the frame and the platform so as to fixedly maintain the platform in either the liferaft retention position or the liferaft deployment position.

16 Claims, 4 Drawing Sheets

LIFERAFT LAUNCH SYSTEM

TECHNICAL FIELD

The present invention relates to apparatus and systems for the deployment of liferaft. More particularly, the present invention relates to apparatus and systems for the davit-initiated release of liferafts from offshore vessels.

BACKGROUND ART

There are many types of rigs, vessels and structures which are required to utilize liferafts in offshore operations. The United States Coast Guard has rather severe and strict requirements for the number of rafts. These requirements relate to the number of persons onboard the offshore vessel. At present, there are many different types of techniques utilized to deploy liferafts from these rigs, vessels and/or offshore structures. Many times, the deployment of the liferafts create insurmountable and hazardous conditions under those emergency situations in which deployment is required.

Where the liferafts are required to be located at a deployment height above the water level, a liferaft davit launch system must be used. This is because it is unsafe for a "float-free" condition. The davit is utilized to pull the liferaft out of the packed container, position the liferaft for autoinflation, and hold the inflated raft in proper position for personnel to board the raft. When the davit winch brake is released, the raft is controlled-gravity lowered to the water by the davit winch box. When the raft encounters the water, the liferaft is autoreleased from the davit lowering cable.

The offshore industry has very high manpower requirements. In many types of offshore drilling rigs and construction vessels, up to seven hundred personnel are aboard. This large number of persons imposes very difficult problems as to how to furnish, store and deploy the large number of liferafts required.

At present, the United States Coast Guard has allowed and accepted liferaft davit launch systems where one launch davit is assigned to handle and launch up to four twenty-five-man liferafts from one station in a controlled sequence. The launching davits have been designed as fixed types, luffing types and slewing types.

Because of the stored liferaft packing container design and construction, the direct relation of the raft container orientation to the davit arm has been a problem of launching systems. It is often difficult to align the liferaft container with the davit arm so that the opening of the liferaft container can be accomplished.

In many offshore structures, there is a requirement that no objects protrude over the side of the vessel. As a result, it is a cumbersome and difficult task to launch the liferaft, to remove the liferaft from the liferaft container and to otherwise control the opening of the liferaft container from within the edge of the offshore structure. It is often necessary to manually move the liferaft container to the edge of the offshore structure. This can be a dangerous operation under such emergency conditions.

It is an object of the present invention to provide a liferaft launch system which presents a optimal raft container orientation.

It is another object of the present invention to provide a liferaft launching system in which, during normal operation, the liferaft containers and davit system are contained within the edge of the offshore vessel.

It is a further object of the present invention to provide a liferaft launch system which enhances the efficiency of raft deployment.

These and other objects and advantages of the present invention will become apparent from a reading of the attached specification and appended claims.

DISCLOSURE OF THE INVENTION

The present invention is a liferaft deployment apparatus that comprises a frame, a platform positioned within the frame, and a liferaft receptacle connected to the platform for receiving liferaft containers. The platform is movable, relative to the frame, between a liferaft retention position and a liferaft deployment position.

The frame comprises a first guide member that extends for the length of the travel of the platform and a second guide member of equal length. The second guide member is parallel to the first guide member. The platform moves between these guide members such that the path of travel of the platform is parallel to each of the guide members. The frame includes suitable stops at each end of the guide members for limiting the travel of the platform. The frame has a first floor plate fixedly attached to the first guide member and a second floor plate fixedly attached to the second guide member. The first and second guide members are L-shaped members extending upwardly and inwardly from the first and second floor plates.

The platform comprises a plurality of rollers rotatably mounted thereto. These rollers allow these platforms to move between the liferaft retention position and the liferaft deployment position. The platform is a plate fastened above the rollers. In more detail, the platform comprises a first angle member positioned within the area bounded by the first floor plate and the first guide member, a second angle member positioned within the area bounded by the second floor plate and the second guide member, and a plate member fastened to and extending between the first and second angle members. Suitable lock means are formed between the frame and the platform for fixing the position of the platform. The lock means comprises four openings formed through the frame and the platform corresponding to the liferaft retention position, four openings formed through the frame and the platform corresponding to the liferaft deployment position, and four pins releasably extending through the four openings corresponding to the liferaft retention position.

The liferaft receptacle comprises a framework connected to the platform. This framework is arranged so as to receive a liferaft container. container. This framework is angularly offset relative to the longitudinal axis of the platform. This framework is arranged so that a liferaft container can be positioned at a thirty degree (30°) angle with respect to the longitudinal axis of the platform.

The present invention is also a liferaft davit launch system that comprises: a davit mounted to a surface, a first liferaft roll platform positioned on one side of the davit, and a second liferaft roll platform positioned on the other side of the davit. The first and second liferaft roll platforms are configured so as to position a liferaft container at an acute angle with respect to the davit. The first and second liferaft roll platforms selectively cause the liferaft container to be movable between a liferaft retention position and a liferaft deployment position.

The davit is mounted adjacent an edge of the surface. This davit is a luffing-type davit. The davit is movable between the first position in which the davit is within the edge of the surface and a second position in which the davit extends beyond the edge of the surface.

The liferaft retention position of the first and second liferaft roll platforms maintains the liferaft container within the edge of the surface. The liferaft deployment position causes a portion of the liferaft container to extend beyond the edge of the surface. The liferaft container is positioned at a thirty degree (30°) angle relative to the edge of the surface when the liferaft roll platforms are in their liferaft deployment position. Particularly, the liferaft container, when positioned in the liferaft deployment position, is arranged such that a line extends at an approximately thirty degree (30°) angle from the end of the davit boom to the liferaft container. Both the first and second liferaft roll platforms have a configuration as described herein previously with respect to the liferaft deployment apparatus.

BEST MODE FOR CARRYING OUT THE INVENTION

Figure 1:
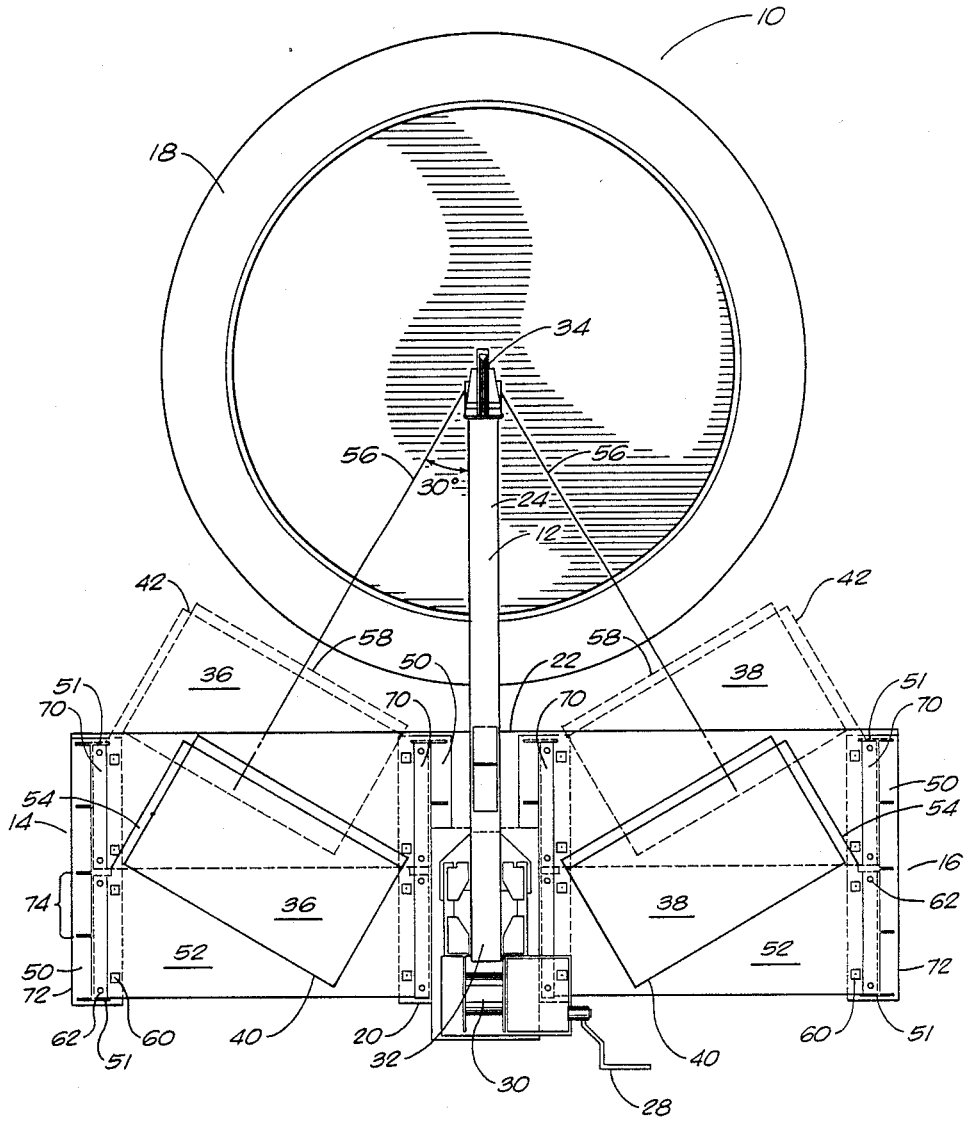
FIG. 1 is a top view showing the liferaft davit launching system of the present invention.

Referring to FIG. 1, there is shown at 10 the liferaft davit launch system in accordance with the preferred embodiment of the present invention. The liferaft davit launch system 10 comprises davit 12, first liferaft roll platform 14 and second liferaft roll platform 16. FIG. 1 shows the liferaft 18 in the various stages of deployment.

Davit 12 is an Alexander luffing davit of a type manufactured by Alexander Manufacturing and Service Co., Inc. of New Orleans, La. Davit 12 is mounted to a surface 20 such as a drill rig, a construction vessel, or other offshore structure. As shown in FIG. 1, davit 12 extends outwardly over edge 22 of surface 20. Davit 12 is mounted generally adjacent edge 22 onto surface 20. As will be described hereinafter in connection with FIG. 5, davit 12 is movable between a first position in which the davit remains within the edge 22 of surface 20 and a second position, shown in FIG. 1, in which davit boom 24 extends outwardly beyond the edge 22 of surface 20. Davit 12 includes the standard davit equipment such as crank handle 28, winch 30, and support structure 32. As will be illustrated hereinafter, the cable for the davit extends over sheave 34 and downwardly to raft 18 or outwardly to either of the raft containers 36 or 38. The first liferaft roll platform 14 is positioned on one side of davit 12. Roll platform 14 is configured so as to position liferaft container 36 at an acute angle with respect to davit 12. The first roll platform 14 is configured so that the liferaft container 36 is movable between a liferaft retention position, illustrated at 40, and a liferaft deployment position, illustrated at 42.

The second liferaft roll platform 16 has a configuration identical to that of the first liferaft roll platform 14. The only difference is that the second liferaft roll platform 16 is located on the opposite side of davit 12 from roll platform 14. Ideally, the liferaft container 38 will be disposed at an angle similar to that of the liferaft container 36 relative to davit 12.

Each of the liferaft roll platforms 14 and 16 includes a frame 50, a roll platform 52 positioned within frame 50, and a liferaft receptacle 54 arranged so as to receive either of the liferaft containers 36 or 38. This configuration of the platform and the frame allows the liferaft containers 36 and/or 38 to be maintained in either of two positions. First, during normal offshore operations, the liferaft containers 36 and 38 will be maintained in a liferaft retention position indicated as position 40. This liferaft retention position allows the liferaft container to be maintained within the edge 22 of offshore structure 20. During emergencies, or for other needs, it may be necessary to deploy the liferaft 18. During deployment operations, the roll platform 14 and 16 will allow the liferaft containers 36 and 38, respectively, to be moved from the liferaft retention position 40 to the liferaft deployment position 42. The liferaft containers 36 and 38 are positioned at a thirty degree (30°) angle relative to the edge 22 of surface 20 in the liferaft roll platforms. By being placed at this angle, the cable 56 extending from the boom 24 of davit 12 will be perpendicular to the forward portion 58 of the liferaft containers 36 and 38. In this position, the cable 56 will be at a thirty degree (30°) angle with respect to the longitudinal axis of the boom 24 of davit 12. In this configuration, the davit cable 56 will be optimally situated for the opening of the liferaft containers 36 and 38 and for the removal of the liferaft therewithin.

The roll platforms 52 include rollers 60 and lock members 62, to be explained hereinafter. As can be seen in FIG. 1, the rollers 60 are placed beneath and at the four corners of the roll platform 52. Similarly, the lock members 62 are located at the four corners of the roll platform 52. The lock members 62 are utilized to lock the roll platform 52 in either the liferaft retention position 40 or in the liferaft deployment position 42.

Figure 2:
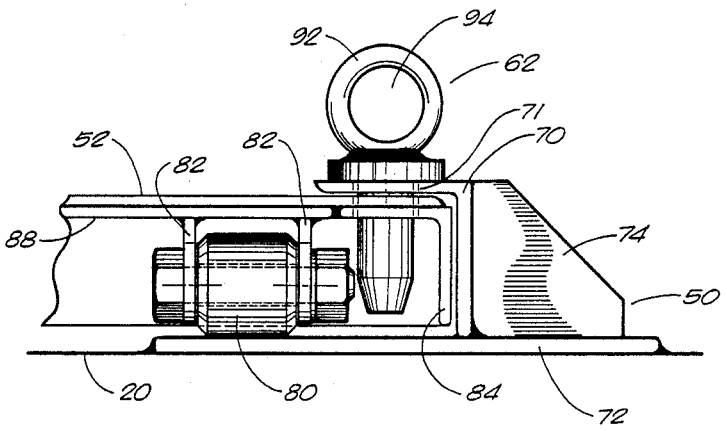
FIG. 2 is a close-up end view showing the relation of the frame and the platform of the liferaft deployment apparatus of the present invention.

FIG. 2 is a close-up illustration of the relationship of the frame 50, the roll platform 52, and the lock member 62. Frame 50 includes guide member 70, floor plate 72, and bracket 74. Guide member 70 extends for the length of travel of the platform 52. Guide member 70 is also correspondingly located on the other side of platform 52. Guide member 70 serves to retain the platform 52 in proper position relative to surface 20. The platform 52 is movable between each of the first and second guide members 70. First guide member 70 is an L-shaped member which extends upwardly and inwardly from the floor plate 72. One edge of the L-shaped member 70 is welded to the floor plate 72. For stability and structural support, bracket 74 is similarly welded to one side of the L-shaped member member 70 and to the floor plate 72. As can be seen in FIG. 1, these brackets 74 occur periodically along the length of the guide members 72. Floor plate 72 is rigidly fastened to the surface 20 of the offshore vessel. Floor plate 72 may be welded, or otherwise attached to surface 20. As can be in FIG. 1, there are two floor plates 72 for each of the roll platforms 14. Alternatively, it may be possible to utilize a single floor plate 72 for each of the roll platforms.

Platform 52 is configured to reside within the bounds established by the guide member 70. Platform 52 is designed to roll in a path parallel to these guide members 70. Platform 52 has a plurality of rollers 80 rotatably mounted to bars 82 extending downwardly and perpendicular to platform 52. Roller 80 abuts against and rolls along the upper surface of floor plate 72. Platform 52 also includes a first angle member 84 which is positioned within the area bounded by the floor plate 72 and the first guide member 70. The other side of the roll platform 14 will include a similar configuration and arrangement of guide member 70, angle member 84, and floor plate 72. A plate member 88 is welded to angle member 84, supports the bars 82, and extends across platform 52. A locking arrangement is provided at 62. This locking arrangement is formed between the frame 50 and the platform 52. Lock arrangement 62 serves to fix the position of the platform 52 within the frame 50. Lock arrangement 62 includes at least one opening 71 which is formed through the L-shaped member 70 of frame 50 and through the angle member 84 of platform 52. The openings in each of these members serve to receive pin 92. Pin 92 has a large ring 94 at one end and extends downwardly through the coinciding openings in the frame 50 and the platform 52. With reference to FIG. 1, it can be seen that there are four such openings formed through the frame 50 and the platform 52 corresponding to the liferaft retention position of the platform. There are also four openings which correspond to the liferaft deployment position of the platform relative to the frame. To properly retain the platform in either of these two positions, four pins 92 will be inserted and extend through the four openings corresponding to the liferaft retention position or the liferaft deployment position, depending upon the particular needs at the time.

Figure 3:
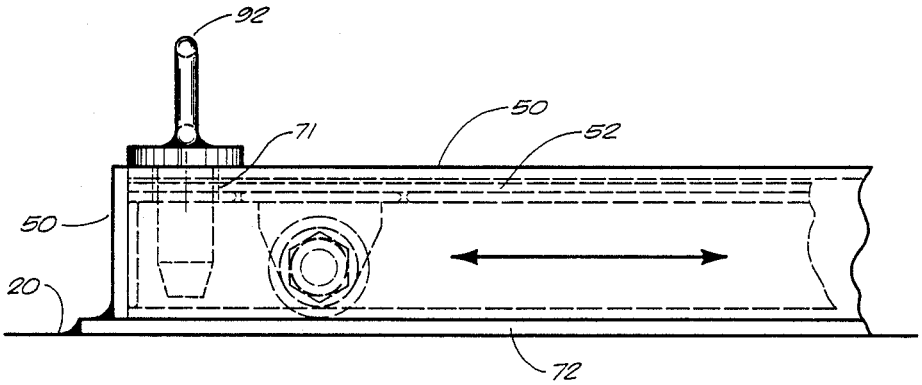
FIG. 3 is a cross-sectional side view showing the rolling relation between the frame and the platform of the present invention.

FIG. 3 illustrates the manner in which the roll platform traverses its path within frame 50. As can be seen in FIG. 3, the platform 52 resides within the confines of the frame 50. Pin 92 extends through the coincidental openings 71, through the frame 50 and through the platform 52. Pin 92 serves to retain the platform 52 in proper position. In this position, roller 80 abuts the top surface of floor plate 72. Floor plate 72 is rigidly affixed to surface 20 of the offshore structure. When pin 92 is pulled from opening 71, the roll platform 52 is free to move in the directions indicated by the arrow in FIG. 3. This allows the roll platform to move toward the liferaft deployment position.

Figure 4:
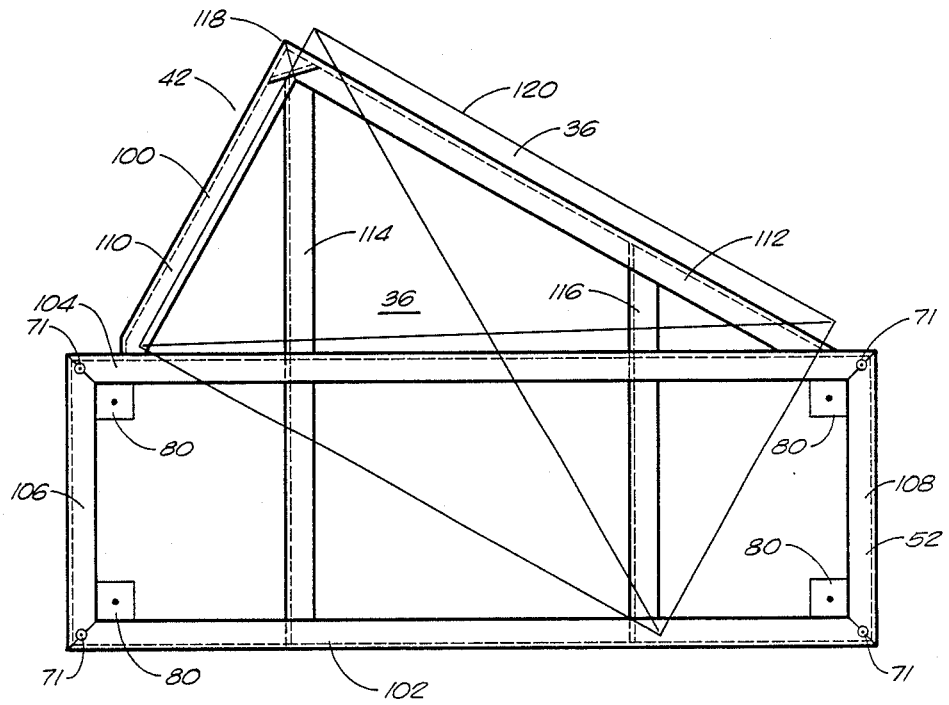
FIG. 4 is a top view showing the platform and the liferaft container, with receptacle, of the present invention.

FIG. 4 isolates the roll platform and associated liferaft container 36. As can be seen, the liferaft container 36 is maintained in proper angled position within the framework 100. The roll platform 52 is shown with horizontal crossmembers 102 and 104. Vertical crossmembers 106 and 108 form a generally rectangular configuration of the basic structure of the roll platform. The openings 71 for the receipt of the locking pins 92 are shown in each of the corners of roll platform 52. The rollers 80 are affixed inwardly of each of the corners of roll platform 52.

The liferaft receptacle 100 comprises a bar 110 angled outwardly from the horizontal crossmember 104 at an angle of approximately sixty degrees (60°). Bar 110 is rigidly fastened to the outer edge of horizontal crossmember 104. Liferaft receptacle 100 also includes angled member 112 which extends from horizontal member 104 at an angle of approximately 30 degrees. Support members 114 and 116 extend vertically from the corner 118 at the junction of members 110 and 112. Support member 114 is attached, at one point, to horizontal member 104, and at the other end to horizontal member 102. The other support member 116 is attached to another location on member 112 and is similarly attached to crossmembers 102 and 104. Liferaft container 36 is positioned onto the liferaft receiving area 100. As can be seen in FIG. 4, liferaft container 36 has a top edge 120 that is maintained at an angle of 30 degrees relative to crossmember 104 and the roll platform 52. The forward edge 120 of liferaft container 36 extends, for a small distance, beyond the outer edges of member 112. It is in this configuration that the liferaft container 36 can be moved backward and forward, as desired, within the liferaft roll platform 14.

Figure 5:
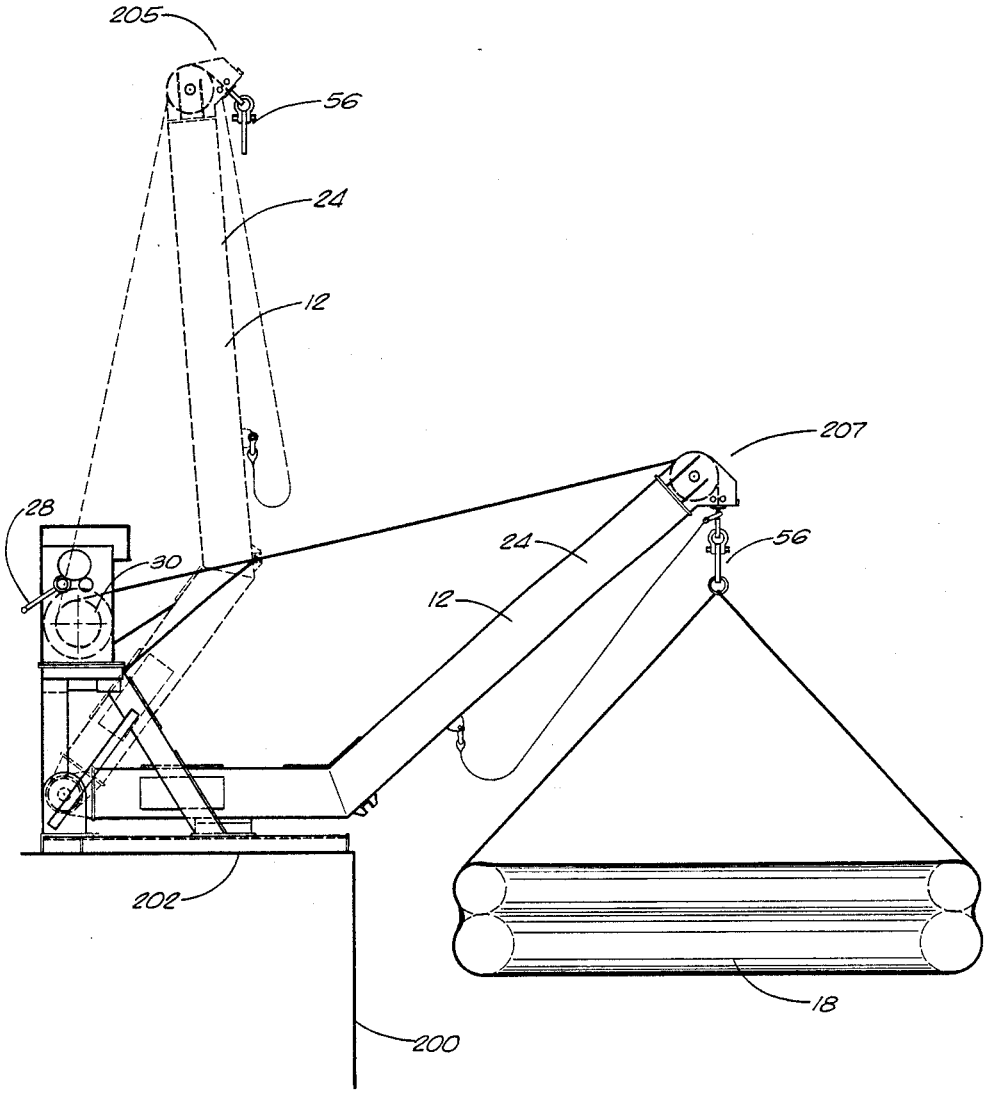
FIG. 5 is a view, in side elevation, showing the operation of the davit liferaft launching system of the present invention.

FIG. 5 illustrates the deployment of the liferaft using the system described hereinbefore. FIG. 5 is a side view showing davit 12 as it is mounted adjacent to edge 200 of surface 202. The davit 12 is movable between a first position in which the davit 12 is within edge 200 of surface 202. This is illustrated by the dotted figure identified at 205. Since the Coast Guard requires, in many cases, that the davit not protrude beyond the edge 200 of the offshore structure, it is often necessary to use the type of davit illustrated in FIG. 5 so as to bring the davit boom 24 upright and within the confines of the offshore structure 202. The second position of the davit is its lowered position illustrated at 207. In this position, the davit boom 24 will be supported on surface 202 and extend outwardly beyond the edge 200 of surface 202. It is in the position 207 that the boom 24 can be utilized to pull the liferaft from the liferaft container 36 and to drop the liferaft 18 into the water below.

In operation, with reference to FIGS. 1 and 5, the liferaft davit launch system 10 of the present invention will typically be in the liferaft retention position 40. In the position 40, the liferaft containers 36 and 38 will be contained within the edge 22 (or 200) of the offshore surface 20 (or 202). Stops 51 serve to limit the amount of travel and to define the inwardmost position of the liferaft containers 36 and 38 with respect to the roll platform 14. Initially, the platform is pinned to the frame in the retention (or stored) position illustrated in solid lines in FIG. 1. This is the typical position that the liferaft containers 36 and 38 will remain in until such times as the need arises for the use of the liferaft 18.

In the instance of an emergency or other situation where liferaft 18 must be deployed, the roll platform 52 is moved by manually pulling the holding pins 92 from the openings 71 between the frame 50 and the roll platform 52. The platform 52 is then manually moved until it abuts the forward stop 51. Upon encountering the forward stop 51, the holding pins 92 are then reinserted into the forward set of four holes 71. This same operation occurs with the first roll platform 14 and the second roll platform 16. In this position, both liferaft containers 36 and 38 are in proper position for deployment.

The construction of the roll platform allows the raft containers 36 and 38 to be mounted at a thirty degree (30°) angle for proper deployment of the raft by the luffing davit. When the luffing davit 12 is in the lowered position 207, the davit cable 56 is attached to the outer edge 120 of the liferaft container 36. By pulling on the outer edge of the container at this point, the liferaft 18 can be properly pulled from the interior of the container. The davit 207 then pulls the liferaft 18 from the container, positions the raft 18 for autoinflation, and then is able to hold the inflated raft in a proper position (illustrated in FIG. 5) for personnel to board the raft. After these personnel have boarded the raft, the handle 28 can be turned or the davit winch 30 released so that the raft may be gravitylowered to the water. When the liferaft reaches the water, the liferaft 18 is released from the davit lowering cable 56.

The present invention allows the liferaft containers to be mounted on a movable unit conveniently stored within the confines of the offshore structure. When in the proper stored position, with the davit boom in the up position, there is nothing that overhangs the vessel's side. With the davit boom in the down deployment position and the roll container support platforms in the deployment position, the davit and raft containers overhang the vessel's side for a proper deployment position. The maintaining of the proper orientation of the liferaft containers 36 and 38 enhances the ability to remove the liferaft from the containers with a minimum of risk to the personnel and for a maximum of efficiency. This also allows one launch davit to handle quickly and conveniently two separate twenty-five-man liferafts from a single station in a controlled sequence. If necessary, as one liferaft is being lowered to the water, the other roll platform can be properly maneuvered. In the next sequence, the unloaded roll platform can then be loaded with another raft container. This is a controlled sequence that maximizes efficiency and maximizes the safety for the personnel on the offshore structure.

The foregoing disclosure and description of the invention is illustrative and explanatory thereof and various changes in the details of the illustrated apparatus may be made within the scope of the appended claims without departing from the true spirit of the invention. The present invention should only be limited by the following claims and their legal equivalents.

I claim:

1. A liferaft deployment apparatus comprising:

a frame;

platform means positioned within said frame, said platform means movable relative to said frame between a liferaft retention position and a liferaft deployment position;

liferaft receiving means connected to said platform for receiving liferaft containers; and lock means formed between said frame and said platform means, said lock means for fixing the position of said platform means, said lock means comprising:

four openings formed through said frame and said platform means corresponding to the liferaft retention position of said platform means relative to said frame;

four openings formed through said frame and said platform means corresponding to the liferaft deployment position of said platform means relative to said frame; and four pins releasably extending through said four openings corresponding to said liferaft retention position of said platform means relative to said frame.

2. The apparatus of claim 1, said frame comprising:

a first guide member extending for the length of travel of said platform means; and a second guide member having a length generally equal to the length of said first guide member, said second guide member being parallel to said first guide member, said platform means movable between said guide members.

3. The apparatus of claim 2, said frame further comprising:

stop means fixedly attached to the ends of said first and second guide means for limiting the travel of said platform means.

4. The apparatus of claim 3, said frame further comprising:

a first floor plate fixedly attached to said first guide member; and a second floor plate fixedly attached to said second guide member, said first and second guide members comprising L-shaped members extending upwardly and inwardly from said first and second floor plates.

5. The apparatus of claim 4, said platform means further comprising:

a first angle member positioned within the area bounded by said first floor plate and said first guide member;

a second angle member positioned within the area bounded by said second floor plate and said second guide member; and a plate fastened to and extending between said first and second angle members.

6. The apparatus of claim 1, said platform means comprising:

a plurality of rollers rotatably mounted to said platform means, said rollers for allowing movement between said liferaft retention position and said liferaft deployment position; and a plate connected to said rollers at a position above said rollers.

7. The apparatus of claim 1, said liferaft receiving means comprising:

a framework connected to said platform means, said framework arranged so as to receive a liferaft container, said framework being angularly offset relative to the longitudinal axis of said platform means.

8. The apparatus of claim 7, said framework arranged so that said liferaft container can be positioned at a thirty degree (30°) angle with respect to the longitudinal axis of said platform means.

9. A liferaft davit launch system comprising:

davit means mounted to a surface;

a first liferaft roll platform positioned on one side of said davit means, said liferaft roll platform configured so as to position a liferaft container at an acute angle with respect to said davit, said first liferaft roll platform selectively causing said liferaft container to be movable between a liferaft retention position and a liferaft deployment position; and a second liferaft roll platform positioned on the other side of said davit means, said second liferaft roll platform configured so as to position a liferaft container at an acute angle with respect to said davit means, said second liferaft roll platform selectively causing said liferaft container to be movable between a liferaft retention position and a liferaft deployment position.

10. The system of claim 9, said davit means mounted adjacent to an edge of said surface.

11. The system of claim 10, said davit means movable between a first position in which said davit means is within the edge of said surface, and a second position in which said davit extends beyond the edge of said surface.

12. The system of claim 10, said liferaft retention position of said first and second liferaft roll platforms for maintaining said liferaft container within the edge of said surface, said liferaft deployment position for causing a portion of said liferaft container to extend beyond the edge of said surface.

13. The system of claim 10, said liferaft container being positioned at a thirty degree (30°) angle relative to said edge of said surface when said first liferaft roll platform is in the liferaft deployment position.

14. The system of claim 9, said liferaft container positioned in said liferaft deployment position so that a line extending from the end of said davit forms an approximately thirty degree (30°) angle with respect to a boom of said davit.

15. The system of claim 9, said first liferaft roll platform comprising:

a frame;

a platform means positioned within said frame, said platform means movable between a liferaft retention position and a liferaft deployment position; and a liferaft receiving means connected to said platform for receiving said liferaft container.

16. The system of claim 9, said second liferaft roll platform comprising:

a second frame;

a second platform means positioned within said frame, said second platform means movable relative to said frame between a liferaft retention position and a liferaft deployment position; and a second liferaft receiving means connected to said platform for receiving said liferaft container.

* * * * *